US006273075B1

(12) United States Patent
Choi et al.

(10) Patent No.: US 6,273,075 B1
(45) Date of Patent: Aug. 14, 2001

(54) METHOD FOR DETECTING MALFUNCTION OF CAR CYLINDER

(75) Inventors: Myung-Sik Choi, Yongin; Hye-Soon Kim, Seoul, both of (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/473,857

(22) Filed: Dec. 28, 1999

(30) Foreign Application Priority Data

Apr. 13, 1999 (KR) ..... 99-12891

(51) Int. Cl.[7] ..... F02D 41/14
(52) U.S. Cl. ..... 123/673; 701/109
(58) Field of Search ..... 123/673; 701/108, 701/109

(56) References Cited

U.S. PATENT DOCUMENTS 4,483,300 * 11/1984 Hosaka et al. ..... 123/673
5,126,943 * 6/1992 Nakaniwa ..... 123/673
5,131,372 * 7/1992 Nakaniwa ..... 123/673
5,605,132 * 2/1997 Hori et al. ..... 123/436
5,787,868 * 8/1998 Maki et al. ..... 123/681

* cited by examiner

*Primary Examiner*—Erick Solis
(74) *Attorney, Agent, or Firm*—Christie, Parker & Hale, LLP

(57) ABSTRACT

Disclosed is a method to determine a failure status of a cylinder and for controlling an air fuel ratio for each cylinder by a simple method using a wide range oxygen sensor. When the engine in a car is in normal status, output values of the wide range oxygen sensor are determined. These measures detect the density of oxygen in the exhaust gasses during a predetermined cycle at specific crank angles, the ensemble average values are found, and the maximum and minimum values of the computed ensemble average values are detected. If the difference between the maximum and minimum values is greater than a set reference value, it is determined that there is a failure of a cylinder, and the position of the cylinder at the maximum or minimum value is determined. The amount of injected fuel is increased or decreased at the determined cylinder position, and the status of the cylinder is determined depending on whether the difference between the maximum and minimum values of the ensemble average values during the predetermined engine cycle is reduced more than the set value, causing a reduction in exhaust emissions and an improvement in driving status.

7 Claims, 5 Drawing Sheets

METHOD FOR DETECTING MALFUNCTION OF CAR CYLINDER

BACKGROUND OF THE INVENTION (a) Field of the Invention

The present invention relates to a method for detecting a malfunction of cylinders in a car. More specifically, the present invention relates to a method for detecting a malfunction of cylinders in a car using a sensor that detects the oxygen content of the exhaust gas from the car.

(b) Description of the Related Art

In a multi point injection (MPI) car, fuel control is determined by considering the amount of air drawn into an engine,, and feedback from an oxygen sensor is used to more accurately control the air fuel ratio. However, since the outputs of the oxygen sensor do not distinguish between cylinders, differences in the volume of intake air between cylinders cannot be compensated for, and neither can fuel delivery abnormalities that result from faulty injectors. As the engine becomes worn, differences between cylinders become greater, and occasional misfires can occur. Currently, the cylinders are distinguished only when the misfires occur according to the OBD-2 method. In the event of a misfire, information such as the crank angular velocity variations can be used to determine the faulty cylinder since there are large variations, but in the event that a mixture is rich or lean, the cylinder in question cannot be distinguished.

Honda products use a wide range oxygen sensor to perform precise air fuel ratio control in a conventional engine, and other products adopt methods to measure ions at an ignition plug or determine the mixture using a pressure sensor.

The Honda products use an observer theory and the wide range oxygen sensor to reduce the nitrogen in the exhaust gas by 5%. However, the observer theory requires a great deal of computation and uses many resources of the engine electronic control unit (ECU). It is important to continually evaluate the oxygen content of the exhaust, and characteristics of the exhaust gas from each cylinder are required to distinguish faulty cylinders, so it is difficult to analyze and control the air fuel ratio for individual cylinders using a wide range oxygen sensor because of the number of computations involved.

SUMMARY OF THE INVENTION

It is an object of the present invention to detect a malfunction of a cylinder using a wide range oxygen sensor so as to control the air fuel ratio for each cylinder.

In one aspect of the present invention, a method for detecting a malfunction of a cylinder in a car comprises the steps of (a) measuring an output value of a wide range oxygen sensor that detects the density of oxygen in the exhaust gas at a crank angle during a predetermined cycle and computing an ensemble average value when an engine of a car is in normal status; (b) finding maximum and minimum values of the computed ensemble average values; (c) determining a difference between the maximum and minimum values to be a malfunction of a cylinder when the difference is greater than a predetermined reference value, and detecting which cylinder is malfunctioning; and (d) increasing or decreasing the amount of injected fuel to the malfunctioning cylinder and determining if the difference between the maximum and minimum values of the ensemble average values during a predetermined engine cycle decreases to below the predetermined reference value.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 2(*a*) shows a mixture that is 10% rich, and FIG. 2(*b*) shows a mixture that is 10% lean;

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

A principle for distinguishing a cylinder that has a rich or lean mixture according to the outputs of the wide range oxygen sensor will now be described according to a preferred embodiment of the present invention.

Figure 1:
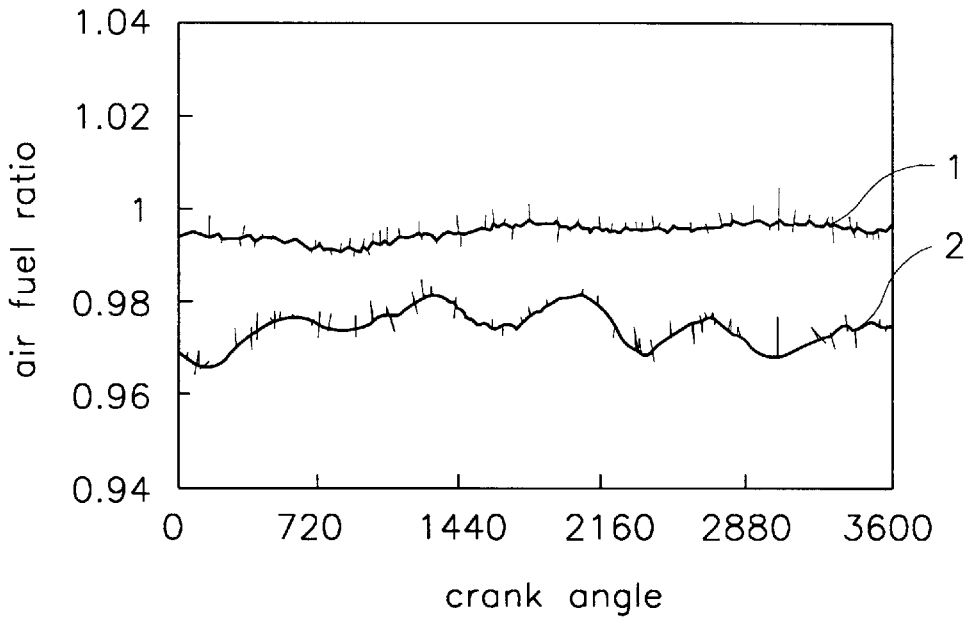
FIG. 1 shows output wave forms of a wide range oxygen sensor according to variations of an air fuel ratio for each cylinder of a car.
Figure 2A:
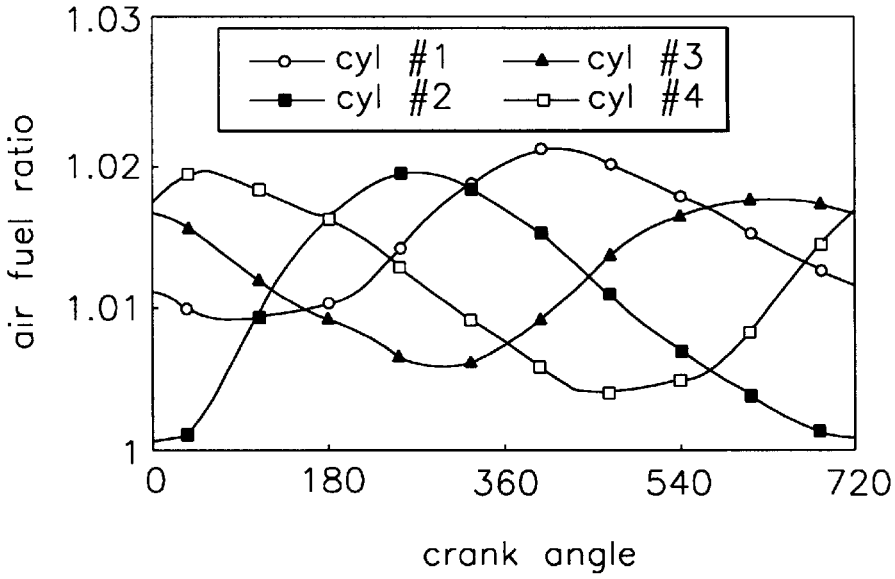
FIGS. 2(*a*) and (*b*) show output wave forms of a wide range oxygen sensor in the event that the air fuel ratio in a single cylinder of a car is changed.
Figure 2B:
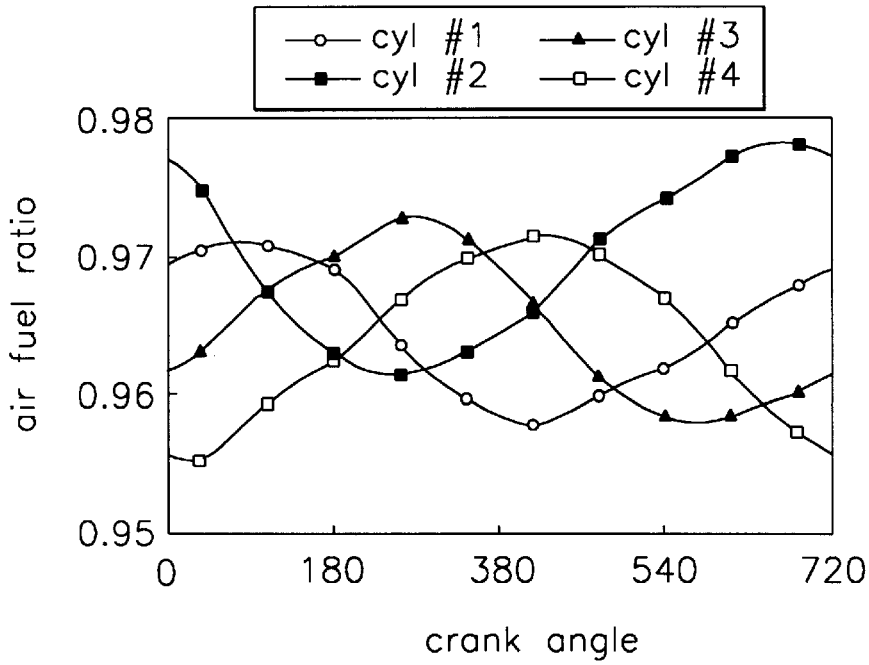

A wide range oxygen sensor installed in an exhaust manifold or catalytic converter can indicate various air fuel ratios for each cylinder, but because of the mixing of the exhaust gasses from each cylinder and the delay in response time of the wide range oxygen sensor, the air fuel ratio outputs for each cylinder are not accurately provided, and as shown by a reference numeral 1 (all the air fuel ratios are equal to one) in FIG. 1, the average value for all the cylinders is provided. When the value of the air fuel ratio of one of the cylinders greatly deviates from the other cylinders, the outputs of the oxygen sensor are, as shown by a reference numeral 2 (an air fuel ratio of one cylinder is 0.9, and an air fuel ratio of another cylinder is 1) synchronized to a cycle of the engine and are shown as sine waves having maximum and minimum values. Among the outputs, the positions of the maximum and minimum values have a constant tendency depending on the engine speed and load, and are displayed at different positions for each cylinder. That is, as shown in FIGS. 2(*a*) and (*b*), when the output values of the wide range oxygen sensor are measured changing the air fuel ratio of each cylinder in order of first, third, fourth, and second cylinders, each cylinder has a phase difference of 180° .

Therefore, in the present invention, a map of the positions of the maximum and minimum values is made as a pre-test, and then, the maximum and minimum values are measured in the engine driving status so as to compare with the values of the map, and therefore, a cylinder that has a greatly deviated air fuel ratio can be distinguished. However, in the event of comparing FIGS. 2(*a*) and (*b*), since the phase difference between the rich cylinder (FIG. 2(*a*)) and lean cylinder (FIG. 2(*b*)) is 360°, when a malfunction of a cylinder is determined, it cannot be accurately determined whether the cylinder has a malfunction or another cylinder having a 360° phase has a malfunction. Hence, information on the air fuel ratio is contained at the minimum value in the rich status and is contained at the maximum value in the lean status, and after the determination of a malfunction of a cylinder, an increase or decrease of the malfunction of the cylinder is detected by changing the amount of fuel so that it can be determined if the malfunctioning cylinder is rich or lean.

Figure 3:
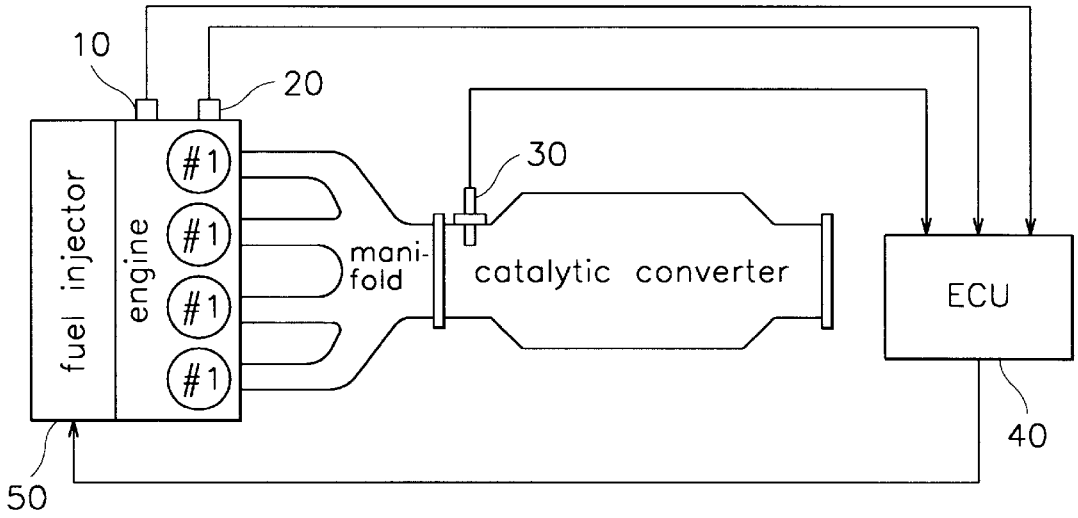
FIG. 3 is a schematic diagram of an apparatus for detecting a malfunction of a cylinder of a car according to a preferred embodiment of the present invention.

FIG. 3 is a schematic diagram of an apparatus for detecting a malfunction of a cylinder of a car according to a preferred embodiment of the present invention. The apparatus comprises an engine rotation number sensor 10, a crank angle sensor 20, a wide range oxygen sensor 30, an ECU 40, and a fuel injector 50.

The engine rotation number sensor 10 detects the rotation number of the engine while driving the car. The crank angle sensor 20 detects the crank angle while driving the car. The wide range oxygen sensor 30, installed in an exhaust manifold or catalytic converter of a car, outputs electric signals depending on the density of the oxygen in the exhaust gas. The ECU 40, while the engine rotation number detected from the engine rotation number sensor 10 maintains a normal state, analyses the signals of the wide range oxygen sensor 30 according to the crank angles detected from the crank angle sensor 20 so as to determine the abnormality of the cylinder. The fuel injector 50 provides fuel to the engine according to the control signals from the ECU 40.

Figure 4A:
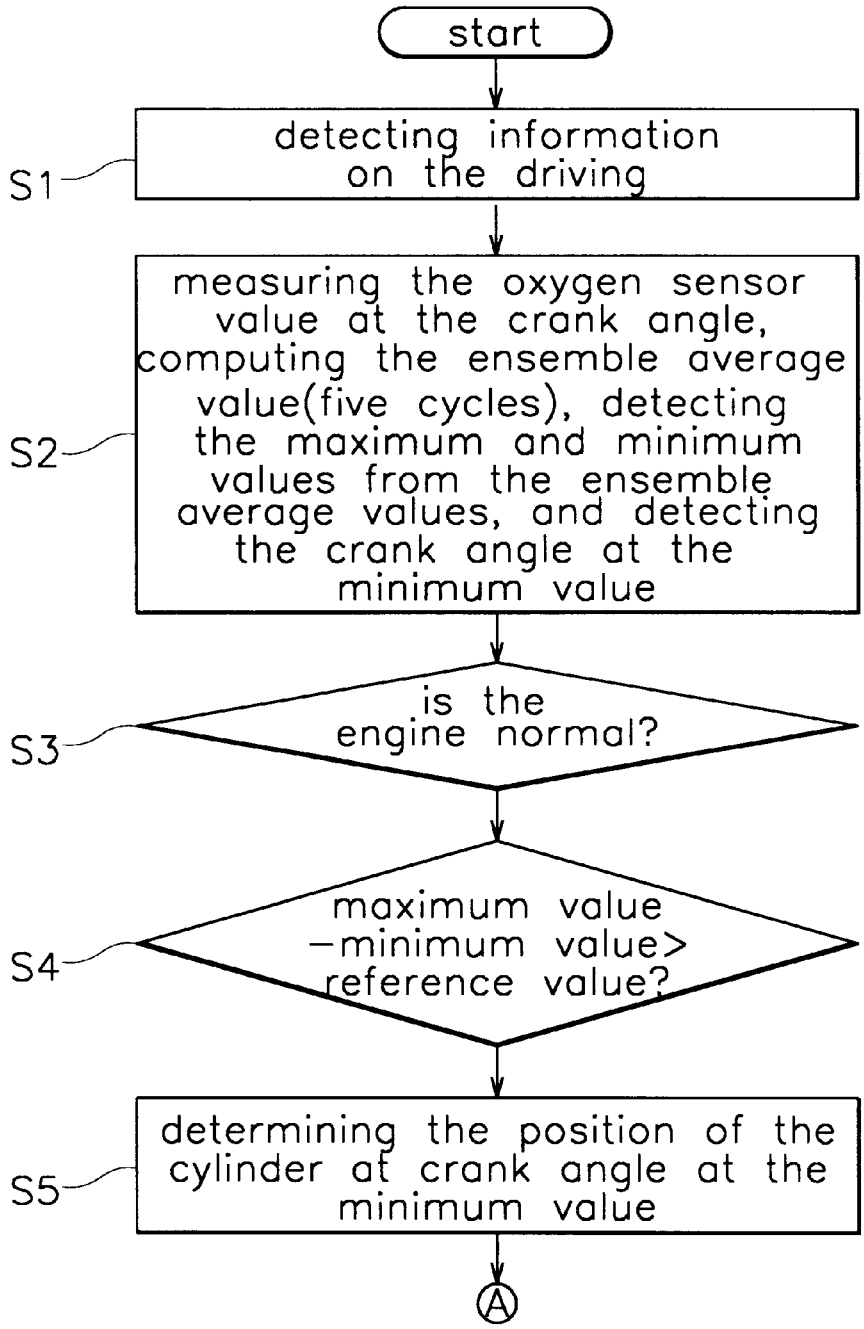
FIGS. 4(*a*) and (*b*) are flow charts of a method for detecting a malfunction of a cylinder of a car according to a preferred embodiment of the present invention.
Figure 4B:
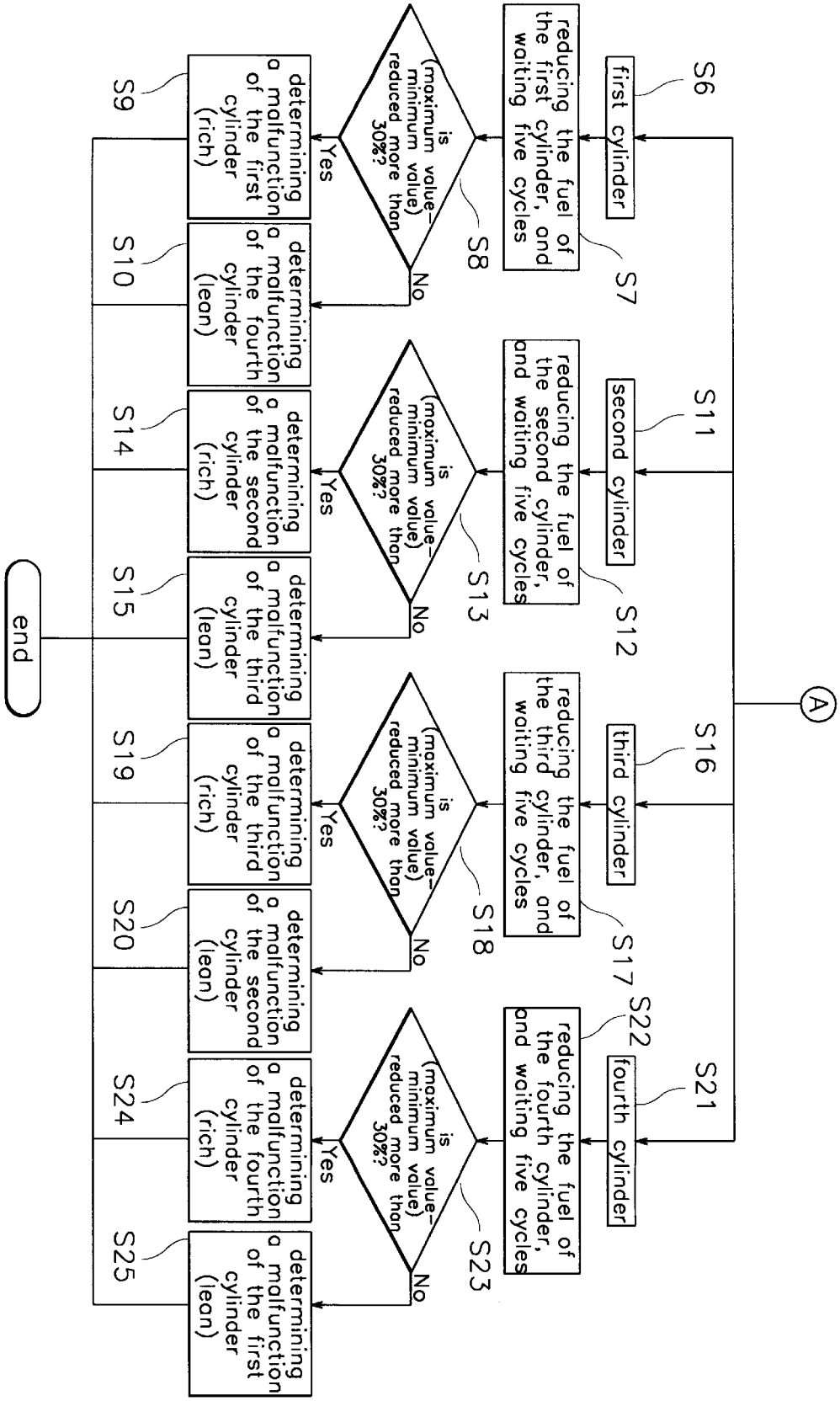

A method for detecting a malfunction of a cylinder in a car will now be described referring to FIGS. 4(*a*) and (*b*).

When the information on the driving such as the engine rotation number, crank angle, and oxygen density of the exhaust gas are detected using the engine rotation number sensor 10, crank angle sensor 20, and wide range air sensor 30 while driving the car in step s1, the ECU 40 measures the electrical signals output from the wide range oxygen sensor 30 according to the oxygen density of the exhaust gasses, and from the crank angle detected from the crank angle sensor 20, it computes an ensemble average value during five engine cycles, and detects maximum and minimum values from the computed ensemble average value, and then detects the crank angle at the minimum value in step s2.

The ECU 40 analyses the engine rotation number detected from the engine rotation number sensor 10 to determine whether the engine is normal in step s3. That is, it is determined that the variations of the engine rotation number of a car detected from the engine rotation number sensor 10 is maintained during five engine cycles within the variation value of the engine rotation number that is set to determine the engine status.

At this time, if the variations of the engine rotation number during the five cycles are maintained within the variation of the engine rotation number so that the engine is determined to be normal, the ECU 40 determines whether the difference between the maximum and minimum value of the ensemble average values of the output values of the wide range oxygen sensor 30 detected from the crank angle is greater than a reference value for detecting a malfunction of the cylinder in step s4. Here, the reference value is defined as a difference between the maximum and minimum values in a reference map of the positions of the maximum and minimum values made from a previous test where the air fuel ratios for the respective cylinders are not greatly different.

If the difference between the maximum and minimum values of the ensemble average values of the output values of the wide range oxygen sensor 30 is greater than the reference value for detecting the malfunction of the cylinder, the ECU 40 determines the position of the cylinder depending on the crank angle at the detected minimum value in step s5.

When the cylinder determined according to the crank angle at the detected minimum value is the first cylinder in step s6, the ECU 40 controls the fuel injector 50 to reduce the fuel supply to the first cylinder in step s7. The maximum and minimum values of the ensemble average values of the wide range oxygen sensor 30 detected at the crank angle during the five engine cycles are detected and it is determined whether the difference is reduced more than the reference value, for example 30%, in step s8. At this time, if the difference between the maximum and minimum values is reduced more than 30%, the ECU 40 determines that a malfunction has occurred in the first cylinder because of the rich air fuel ratio in step s9, and otherwise, the ECU 40 determines that a malfunction has occurred in the fourth cylinder because of the lean air fuel ratio in step s10. The reason for this is, in the event that the strokes of the engine are performed in order of first, third, fourth, and second cylinders, the output values of the wide range oxygen sensor 30 indicates the phase of 360° under the status that the air fuel ratio of the first and fourth cylinders and the air fuel ratio of the third and second cylinders are rich or lean.

When the cylinder determined according to the crank angle of the detected minimum value is the second cylinder in step s11, the ECU 40 controls the fuel injector to reduce the fuel supply of the second cylinder in step s12. The ECU 40 detects the maximum and minimum values of the ensemble average values of the output values of the wide range oxygen sensor 30 detected at the crank angle during the five engine cycles and determines whether the difference is reduced more than 30% compared to the previous one in step s13. At this time, if the difference between the maximum and minimum values is reduced more than 30%, the ECU 40 determines that a malfunction has occurred in the second cylinder because of the rich air fuel ratio in step s14, and otherwise, the ECU 40 determines that a malfunction has occurred in the third cylinder because of the lean air fuel ratio in step s15.

When the cylinder determined according to the crank angle of the detected minimum value is the third cylinder in step s16, the ECU 40 controls the fuel injector 50 to reduce the fuel supply of the third cylinder in step s17. The ECU 40 detects the maximum and minimum values of the ensemble average values of the output values of the wide range oxygen sensor 30 detected at the crank angle during the five engine cycles and determines whether the difference is reduced more than 30% compared to the previous one in step s18. At this time, if the difference between the maximum and minimum values is reduced more than 30%, the ECU 40 determines that a malfunction has occurred in the third cylinder because of the rich air fuel ratio in step s14, and otherwise, the ECU 40 determines that a malfunction has occurred in the second cylinder because of the lean air fuel ratio in step s20.

When the cylinder determined according to the crank angle of the detected minimum value is the fourth cylinder in step s21, the ECU 40 controls the fuel injector 50 to reduce the fuel supply of the fourth cylinder in step s22. The ECU 40 detects the maximum and minimum values of the ensemble average values of the output values of the wide range oxygen sensor 30 detected at the crank angle during the five engine cycles and determines whether the difference is reduced more than 30% compared to the previous one in step s23. At this time, if the difference between the maximum and minimum values is reduced more than 30%, the ECU 40 determines that a malfunction has occurred in the fourth cylinder because of the rich air fuel ratio in step s24, and otherwise, the ECU 40 determines that a malfunction has occurred in the first cylinder because of the lean air fuel ratio in step s25.

On the other hand, it is also possible that the malfunctioning cylinder is determined according to the crank angle at the maximum value, and as the amount of the injected fuel is increased the malfunction is determined to be generated in the cylinder by the rich or lean air fuel ratio via the reduction of the error.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method for detecting a malfunction of a cylinder in a car, comprising the steps of:

(a) measuring an output value of a wide range oxygen sensor that detects density of oxygen in the exhaust gas at a crank angle during a predetermined cycle and computing an ensemble average value when an engine of a car is in normal status;

(b) finding maximum and minimum values of the computed ensemble average value;

(c) determining a difference between the maximum and minimum values to be a malfunction of the cylinder when the difference is greater than a predetermined reference value set for determining a malfunction of a cylinder, and detecting a position of the cylinder, via the crank angle, at the maximum or minimum values; and (d) increasing or decreasing injected fuel at the detected position, and determining a malfunction of the cylinder according to whether the difference between the maximum and minimum values of the ensemble average values during a predetermined engine cycle decreases more than a previously set value.

2. The method of claim 1, wherein in the step (d), after the determination, the amount of the injected fuel is reduced at the position of the determined cylinder, and if the difference between the maximum and minimum values of the ensemble average values of a predetermined cycle of the engine is reduced more than a previously set value, it is determined that a malfunction has occurred in the determined cylinder because of a rich air fuel ratio.

3. The method of claim 2, wherein if the difference is not reduced more than the previously set value, it is determined that a malfunction has occurred in the cylinder positioned at an engine ½ cycle from the determined position of the cylinder.

4. The method of claim 1, wherein in the step (d), when the position of the cylinder at the maximum value of the ensemble average values is determined, the amount of the injected fuel at the determined position of the cylinder is increased, and if the difference between the maximum and minimum values of the ensemble average values during a predetermined engine cycle is reduced more than a previously set value, it is determined that a malfunction has occurred in the cylinder because of the lean air fuel ratio.

5. The method of claim 4, wherein if the difference is not reduced more than the set value, it is determined that a malfunction has occurred in the cylinder position at a ½ engine cycle from the determined position of the cylinder because of the rich air fuel ratio.

6. An air fuel ratio feedback control method for a multi-cylinder engine comprising:

sensing crank angle position with a crankshaft position sensor;

sensing exhaust gas composition with an oxygen sensor at a confluence of exhaust streams from individual cylinders and producing a sensor signal indicative of the average air fuel ratio of all of the cylinders;

finding a minium value and a maximum value for the average air fuel ratio during a predetermined number of engine cycles;

determining a cylinder malfunction to have occurred when the difference between the maximum and the minium average air fuel ratio values is above a reference upper value or is below a reference lower value;

detecting a crank angle position at which the minimum value of the air fuel ratio occurs, wherein the detected crank angle position corresponds to a particular cylinder position; and increasing or decreasing injected fuel at the cylinder corresponding to the detected crank angle position until the difference between the maximum and the minium average air fuel ratio values is below a reference upper value and above a reference lower value.

7. An air fuel ratio feedback control method for a multi-cylinder engine comprising:

sensing crank angle position with a crankshaft position sensor;

sensing exhaust gas composition with an oxygen sensor at a confluence of exhaust streams from individual cylinders and producing a sensor signal indicative of the average air fuel ratio of all of the cylinders;

finding a minium value and a maximum value for the average air fuel ratio during a predetermined number of engine cycles;

determining a cylinder malfunction to have occurred when the difference between the maximum and the minium average air fuel ratio values is above a reference upper value or is below a reference lower value;

detecting a crank angle position at which the maximum value of the air fuel ratio occurs, wherein the detected crank angle position corresponds to a particular cylinder position; and increasing or decreasing injected fuel at the cylinder corresponding to the detected crank angle position until the difference between the maximum and the minium average air fuel ratio values is below a reference upper value and above a reference lower value.

* * * * *

UNITED STATES PATENT AND TRADEMARK OFFICE

CERTIFICATE OF CORRECTION

PATENT NO. : 6,273,075 B1
DATED : August 14, 2001
INVENTOR(S) : Myung-Sik Choi and Hye-Soon Kim It is certified that error appears in the above-identified patent and that said Letters Patent is hereby corrected as shown below:

Column 6,
Lines 20, 26, 34, 46, 51 and 59, replace “minium” with -- minimum -- (all occurrences).

Signed and Sealed this

Twenty-seventh Day of August, 2002

*Attest:*

*Attesting Officer*

JAMES E. ROGAN
*Director of the United States Patent and Trademark Office*